United States Patent [19]

Herman

[11] 4,191,127

[45] Mar. 4, 1980

[54] GALVANIZING APPARATUS FOR WIRE AND THE LIKE

[75] Inventor: Joseph L. Herman, Palos Park, Ill.

[73] Assignee: The Joseph L. Herman Family Trust

[21] Appl. No.: 848,712

[22] Filed: Nov. 4, 1977

[51] Int. Cl.[2] ..... B05C 5/00; B05C 11/04; B05C 11/06; B05C 11/08

[52] U.S. Cl. ..... 118/57; 118/65; 118/69; 118/125; 118/325

[58] Field of Search ..... 118/65, 64, 125, 69, 118/325, 122, 57; 427/357, 432, 433, 434 D

[56] References Cited

U.S. PATENT DOCUMENTS

| | | | |
|---|---|---|---|
| 2,093,857 | 9/1937 | Williamson et al. | 118/125 X |
| 2,159,297 | 5/1939 | Shover | 118/65 |
| 2,166,249 | 7/1939 | Herman | 118/65 |
| 2,375,434 | 5/1945 | Moise et al. | 118/65 |
| 2,914,423 | 11/1959 | Knapp | 118/125 X |
| 3,809,570 | 5/1974 | Herman | 118/325 X |
| 3,961,601 | 6/1976 | Hunter | 118/57 |
| 4,082,868 | 4/1978 | Schnedler et al. | 118/65 X |

*Primary Examiner*—John P. McIntosh
*Attorney, Agent, or Firm*—Hill, Van Santen, Steadman, Chiara & Simpson

[57] ABSTRACT

A method and apparatus for galvanizing galvanizable metal in a wire-like form. A descaled wire or the like is passed vertically and upwardly through a transversely flowing stream of molten zinc after which the so-coated wire or the like is either passed into a second processing zone or is passed through a shaping orifice, or both, as desired. The resulting so-processed wire is then cooled preferably by quenching in a flowing water bath.

5 Claims, 3 Drawing Figures

GALVANIZING APPARATUS FOR WIRE AND THE LIKE

BACKGROUND OF THE INVENTION

In my U.S. Pat. Nos. 3,809,570 and 3,828,723, I provide a method and apparatus for evenly and uniformly galvanizing wire, strip steel and the like by passing such vertically and upwardly through a transversely flowing stream of molten zinc after which the so-coated wire like form is maintained in a vertical position in an oxygen-free atmosphere until resulting coating of zinc has solidified without the coated wire coming into contact with any solid object. Optionally, after being coated and before the coating has solidified, the so-coated wire-like form can be subjected to a gas wipe.

In the commercial application and development of this technology, it is my understanding that certain problems may be encountered.

For one thing, if the zone wherein the upwardly flowing wire member passes through a generally transversely flowing stream of molten zinc is well insulated, and also if the wire being so coated is moving at a fairly rapid rate, it is possible that an appreciable distance may be required along the path of vertical wire travel before solidification of zinc on the wire-like form occurs which suggests that a relatively large and bulky apparatus might be necessary or desirable particularly in a situation where it is desired not to employ a water quench or the like as the wire leaves the galvanizing apparatus traveling vertically.

For another thing, if a gas wipe is employed, it might be desirable to utilize in the gas wipe a gas which has been pre-heated. For reasons of fuel conservation and process economies, it is my understanding that it then would be desirable to recycle gas used for gas wiping. However, I am informed that such a recycle would probably require the use of a gas compressor that would have to operate at elevated temperatures. While such compressors are known, they are expensive and consequently would add to the cost of equipment used for the practice of this technology.

BRIEF SUMMARY OF THE INVENTION

I have now discovered means for overcoming the possible disadvantages above described for the technology described in my afore-indicated U.S. patents. In addition, the present methods and means provide technology which I believe to be highly advantageous and well suited for the practice of galvanizing wire-like forms.

In one aspect, my present invention relates to an improved apparatus for galvanizing a wire-like form of generally uniform cross-sectional size by passing such a wire-like form vertically upwardly through a generally transversely flowing stream of molten zinc while maintaining the zinc and the wire-like form in a substantially oxygen-free atmosphere. Thereafter, the so-coated wire-like form, before the zinc on the wire has solidified and while the so-coated wire is still moving vertically in an oxygen-free atmosphere, is passed through an orifice thereby to conform exterior surface portions of such coating on such wire to the cross sectional configuration of such orifice. Finally, the so drawn and coated wire is cooled so as to solidify the coating on the wire while the wire is still moving vertically upwardly in an oxygen-free atmosphere free from contact with solid objects.

In another aspect, my invention relates to an improved apparatus for galvanizing a galvanizable metallic material in a wire-like form in which the wire-like form is passed in a first zone vertically upwardly through a generally transversely flowing stream of molten zinc while maintaining in the first zone a substantially oxygen-free atmosphere. Then, the so-coated wire-like form is passed through an aperture into a second zone before the coating of zinc on such wire-like form has solidified and while such so-coated wire-like form is still moving vertically upwardly. The second zone has maintained therein a substantially oxygen-free atmosphere. Also, the second zone is maintained at a lower temperature than the temperature of the first zone. Finally, the so-coated wire is cooled to solidify such coating on such wire while the wire is still moving vertically upwardly in an oxygen-free atmosphere free from contact with solid objects.

Advantages, features, objects, aims, modifications, applications and the like will be apparent to those skilled in the art from the teachings of my present specification taken together with the accompanying drawings.

DETAILED DESCRIPTION

Figure 1:
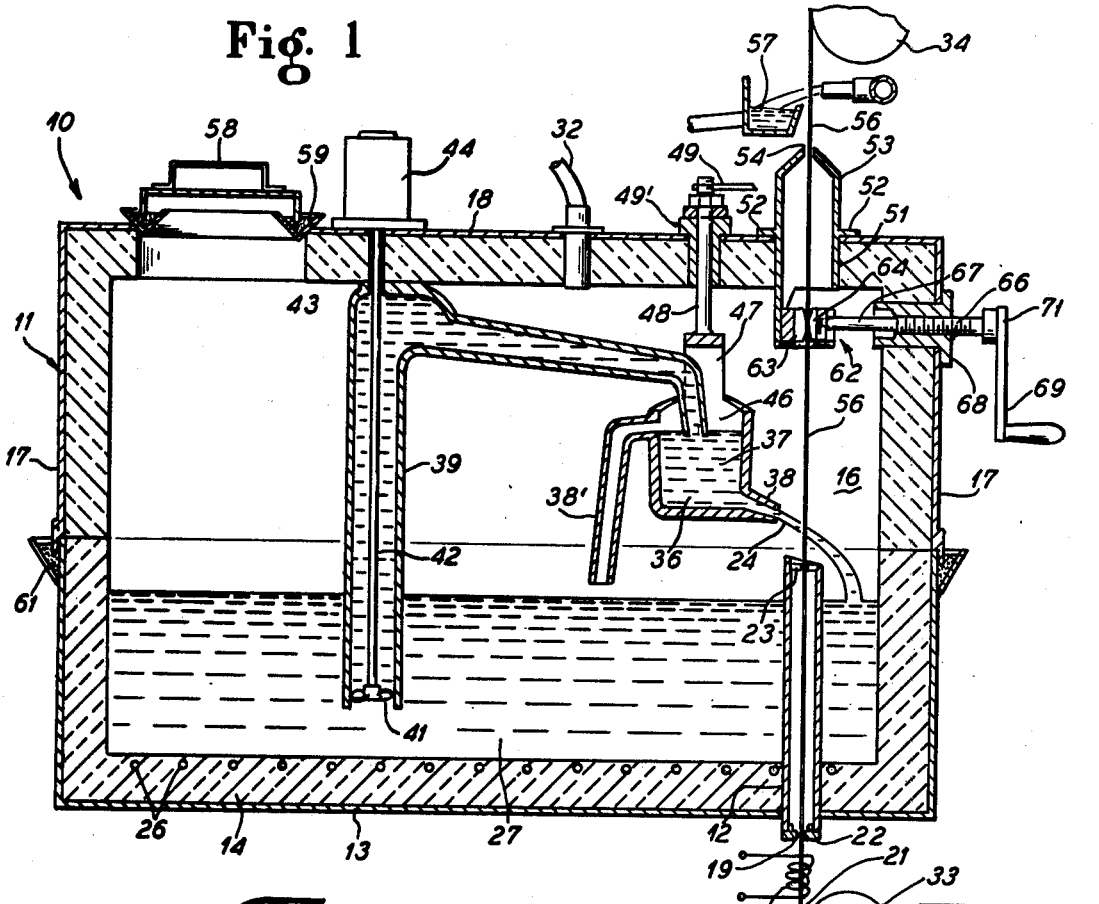
FIG. 1 is a schematic side elevational partially sectionalized view of one embodiment of apparatus adapted for the practice of the present invention.

The term "wire-like", or even "wire", or equivalent, is used herein as a matter of convenience as a generic term inclusive of wire, cable, strip of relatively narrow width, filaments, fibers, long strands, and the like.

In the practice of this invention, one passes preferably substantially completely descaled, preferably substantially completely dry wire of galvanizable, preferably iron-containing, material vertically through a generally transversely flowing (relative to the direction of wire movement) stream of molten zinc while maintaining the zinc and the wire in a substantially oxygen-free atmosphere. Immediately before, during and immediately after contact between zinc and wire, the wire is maintained out of contact with any solid object.

After being thus coated with zinc, before the coating on the zinc has solidified and while the so-coated wire is still moving vertically upwardly in an oxygen-free atmosphere, the wire may be passed through at least one orifice. Such an orifice has a generally vertically oriented axis and further has a cross-sectional configuration which is generally proportional to the cross-sectional configuration of the uncoated wire. However, the cross-sectional configuration of the orifice is slightly larger than the cross-sectional size of such uncoated wire-like form.

Alternatively, or in addition, a wire so-coated may be, in accordance with the teachings of this invention, passed through an aperture into a separate zone from that in which contact between molten zinc and wire takes place. Such passage into such second zone takes place before the coating of zinc on wire has solidified and while such coated wire is still moving vertically. This subsequent or second zone has maintained therein a substantially oxygen-free atmosphere but this second zone is maintained at a lower temperature than the temperature maintained in the first or coating zone.

If desired, a coated wire can be both moved into a second zone through an aperture and then passed through an orifice. If desired, the aperture separating a first zone from a second zone can be an orifice as described above.

After being so-passed or drawn through an orifice, and/or after passing into such a second zone, the resulting so-coated wire is subjected to cooling so as to solidify the zinc coating thereon until cooling is completed (until solidification of zinc has occurred) a coated wire is still moved vertically upwardly in an oxygen-free atmosphere free from contact with solid objects.

More than a single wire can be processed simultaneously, depending upon apparatus and process considerations, as those skilled in the art will appreciate. Conveniently and preferably the final cooling of coated wire may be accomplished by moving a zinc coated wire upwardly through a water bath. The temperature of the water bath and the residence time of such so-coated wire in such bath are chosen so that the resulting coating of zinc on such wire has cooled and set before the so-coated wire emerges from the bath. The so-coated and cooled wire may be permitted to enter an oxygen-containing atmosphere after leaving such water bath. Preferably the water bath is in the form of one or more streams of water which flow in a direction generally transverse relative to the vertically oriented coated wire.

Typically, the thickness measured vertically through a flowing stream of molten zinc at the point where the wire passes therethrough is not more than about 2 inches in vertical thickness. Preferably, this thickness is not more than about 1 inch at such place, though larger and smaller such thicknesses can readily be used without departing from the spirit and scope of this invention, as those skilled in the art will appreciate. The wire vertically travels through such flowing stream of zinc at rates typically in the range of from about 10 to 50 feet per minute, although those skilled in the art will appreciate that slower and faster travel rates can be used without departing from the spirit and scope of this invention. One presently preferred travel rate lies in the range from about 15 to 25 feet per minute.

The flowing stream of zinc is preferably maintained during a galvanizing operation at a substantially constant temperature when the wire passes therethrough. Typical stream temperatures fall in the range of from about 800° to 900° F.

Typically wires coated in accordance with the teachings of the present invention have coating weights of zinc of not more than about 2 ounces per square foot of coated wire surface at a maximum, but lower or higher such coating weights may be employed if desired. In terms of coating thickness, such a typically coated and cooled wire produced by the teachings of this invention has a coating of zinc which ranges from about 0.05 to 0.0001 inch. It is preferred to use the present invention to prepare wires which are coated with a relatively thin layer of zinc; thus, one class of preferred coating thicknesses ranges from about 0.0001 to 0.001 inch.

Preferred galvanizable metallic materials include iron and iron alloys, especially steel. One preferred class of wire-like forms comprises steel containing not more than about 0.4 weight percent carbon, as those skilled in the art will appreciate.

Before being subjected to a galvanizing operation in accordance with the teachings of this invention, a wire should preferably be free of oil, grease, drawing lubricants, mill scale, and other surface contaminants, as those skilled in the art will readily appreciate. Any conventional de-greasing and/or acid pickling operation may be used as desired by one skilled in the art before subjecting a wire to a galvanizing operation in accordance with the teachings of this invention.

For example, to clean a wire, one or more of several conventional methods may be used, including vapor de-greasing, solvent cleaning, alkaline cleaning, and emulsion cleaning. Aqueous solutions of sulfuric acid (or to a lesser extent, of hydrochloric acid) are commonly used to remove mill scale and rust in a so-called acid pickling operation prior to galvanizing. The concentration of sulfuric or hydrochloric acid in pickling baths normally ranges from about 6.5 to 13.5 ounces of sulfuric acid or hydrochloric acid per gallon of water. Preferably, the pickling solution used is maintained at a temperature in the range typically from about 140° to 175° F., though it is perferred to use hydrochloric acid solutions at about room temperature (about 75° to 100° F.) to avoid dangerous fuming.

After de-greasing and pickling, it is preferred to subject a wire to a thorough rinsing operation to remove from the wire iron salts, finelly divided iron and possibly other contaminants. To be as effective as possible, the rinsing operation may be combined with a scrubbing action, as those skilled in the art will appreciate.

Any small amounts of impurities remaining on a wire after de-greasing, pickling, water rinsing and/or other cleaning procedures employed may be removed, as those skilled in the art will appreciate, using a flux. Although so-called "wet" and "dry" galvanizing requires fluxes and employs essentially the same flux materials, the composition of the flux is partly dependent upon a specific galvanizing method employed. Here, if a flux is employed, it is preferred to apply the flux to the surface of the wire before such is contacted by molten zinc.

After such preparatory procedures, a wire is dried substantially completely by being heated to a temperature in the range of from about, for example, 250° to 400° F., although those skilled in the art will appreciate that lower and higher temperatures may here be used if desired. If a filament has been subjected to a flux, during drying, surface chlorides and oxides can be taken up by reaction with a portion of the flux. The remaining flux then contributes to the wetting action when the filament is passed through the molten zinc bath. In a preferred procedure for practicing the process of the present invention, just before being contacted with molten zinc, a suitably otherwise prepared wire is passed through a heating zone so as to pre-heat the wire prior to the time when the wire is contacted with molten zinc in accordance with the practice of the present invention. Suitable pre-heat temperatures are in the range of from about 800° to 900° F. although hotter and colder temperatures can be employed without departing from the spirit and scope of the present invention.

Any grade of zinc conventionally used in galvanizing, such as zincs covered in ASTM B6 can be used in galvanizing. One preferred type of zinc is the so-called prime Western Zinc which reportedly contains about the highest commercially allowable percentage (1.68%) of lead and iron. As those skilled in the art will appreciate, the purity of the zinc used in galvanizing has an effect on the bending properties of the product coatings. In general, particularly when coatings with good bending properties are to be produced in accordance with the practice of the present invention, a high purity zinc is preferred; for this purpose, a zinc grade, such as has been conventionally used for many years in producing high quality galvanized zinc, may be employed, such as the type or grade of zinc which is used where the coating is to be heavy and is not to flake when bent, as for example, in splicing.

In general, cracking of a zinc coating produced by the technique of this invention may be minimal or reduced apparently due to the short contacting time of the wire with the molten zinc, which seems to result, in time, in small sized crystals of iron zinc compounds being formed, although I do not wish to be bound by theory herein.

Although pure zinc melts at approximately 787° F., molten zinc baths can be operated at higher temperatures, for purposes of the present invention, presently preferred temperatures being in the range of from about 800° to 900° F. Higher temperatures may be used, such as temperatures above about 900° F. or higher, but such temperatures can increase the solution rate of iron and steel in zinc, and the effects of these temperatures on a wire being galvanized may be harmful. Within the above indicated normal galvanizing temperature range, an increase in temperature can (a) allow more complete drainage of zinc from the galvanized wire, (b) increase the fluidity of the molten zinc, and (c) heat the wire to a higher temperature as it passes through the zinc stream. Thus, temperature regulation may be used to control galvanizing quality.

An increase in bath fluidity generally improves the drainage and is desirable provided the bath temperature does not exceed the normal operating range. However, as those skilled in the art will appreciate, an increase in bath temperature produces a sharper temperature gradient from the surface to the center of the wire, and higher wire temperatures may also extend the time required for the zinc to solidify after a wire is withdrawn from a bath.

A preferred operating procedure when practicing the present invention is to determine an optimum bath temperature for a given filament or wire to be galvanized by starting at a relatively low temperature in the normal range (800° to 900° F.) and raising the temperature in increments of approximately 5° F. until the most satisfactory galvanizing results are obtained. Those skilled in the art will appreciate that modifications in this approach, such as preheating the work piece, or adding small amounts of aluminum to the bath to increase fluidity, may also be employed.

In order to avoid and/or substantially minimize corrosion and contamination problems, the region around the flowing bath of molten zinc used to coat a wire in accordance with the teachings of the present invention is maintained in a substantially oxygen-free gaseous environment. Also, a coated wire produced in accordance with the teachings of this invention is maintained in a substantially oxygen-free gaseous environment until after the zinc coating on the wire has solidified. Such environments may be achieved by using reduced pressure or vacuum conditions. I presently prefer to employ a substantially non-oxidizing or substantially oxygen-free gaseous environment in the region of galvanizing and freshly coated wire such as is taught, for example, in my earlier patents in this art; see, for examples, Herman U.S. Pat. No. 2,166,251 and U.S. Pat. No. 2,166,250. Conveniently, for example, the coating zone wherein the flowing stream of zinc contacts a wire being galvanized, and the subsequent or second zone whereinto a wire coated with molten zinc passes can be filled with a gas or gas mixture comprised, for example, of nitrogen, helium, gaseous halogenated hydrocarbons, gaseous lower aliphatic hydrocarbons (such as the mixtures commercially available under such names and trade designations as "natural gas" or "city gas"), and the like. When, for example, natural or city gas is used, at every opening from the galvanizing chamber gas escapes and may be burned by igniting same at such openings. Preferably, about a wire, the flame passes upwardly and outwardly, and envelops the wire, and so adds to and aids in providing an oxygen-free environment.

The residence time of a wire being galvanized in a flowing stream of molten zinc can be varied. Such residence time is to some extent dependent on ease of handling, processing conditions, nature of the wire, etc., and in optimum processing emersion time for each type of wire being galvanized necessarily can be established by trial. In addition, duration of emersion in a flowing stream of molten zinc for a given wire can be varied but typically falls in the range of from about 0.001 to 10 seconds, although longer and shorter times, as desired may be employed as those skilled in the art will appreciate. A reaction between clean steel being galvanized and molten zinc contacting same may proceed relatively rapidly at first resulting in the production of an alloy layer which can continue to grow at a decreased rate the longer the zinc is in contact with the wire and remains in a molten condition.

After a coated wire is withdrawn from a flowing bath of molten zinc, it continues to move vertically, as indicated. Preferably, before a so-coated wire is permitted to re-enter an oxygen-containing atmosphere, and in accordance with the teachings of this invention, the molten zinc is solidified by cooling. For purposes of the present invention, it is convenient and preferred to pass a coated wire through a water bath, as indicated above, wherein the coated wire is in an oxygen-free atmosphere before the wire reaches an oxygen atmosphere.

The temperature of the water bath, and the residence time of a zinc coated wire in such bath, are chosen such that the resulting coating of zinc on such a coated wire has cooled and set by the time the wire leaves the bath. Conveniently a jet of water is permitted to flow onto and against and around a coated wire or the like generally transversely of the coated wire the water jet being located adjacent the second zone above described. Water reaching the zinc coating has direct contact thereon. A plurality of streams of water may be thrown against a wire as it moves vertically therethrough.

In accordance with the practice of this invention, in a zinc coating operation, a given wire may be subjected to passage through one or more flowing streams of molten zinc.

The present invention may be practiced in combination with a gas wipe, if desired. Preferably, the gas used in the gas wipe is substantially free of oxygen and is preferably at a temperature of from about 800° to 900°

F. and is preferably generally downwardly directed, (more preferably angularly) as a flowing stream circumferentially about a moving wire vertically travelling. The function of such a gas wipe is to thin down and smooth out the zinc coating on a wire substrate to conserve zinc and to produce a more uniform even and thin coating of zinc on a wire. Some control of zinc weights can be had by regulating gas pressure in the wipe. The present invention is well adapted for the production of thin, uniform, coatings of zinc on wires.

If thin strips of flattened materials are being zinc coated by the practice of the present invention, it is presently preferred to have such strips enter the molten zinc bath at an angle which is substantially parallel to the direction of zinc flow so that the molten zinc moves easily and generally equally across each of the opposed faces of such an individual strip member.

Referring to FIG. 1, there is seen an embodiment of apparatus suitable for galvanizing a wire in accordance with the teachings of the present invention, such apparatus being herein designated in its entirety by the numeral 10. The apparatus 10 employs a generally gas-tight vessel herein designated in its entirety by the numeral 11 which is equipped with a wire entry channel 12 which extends through the bottom wall 13 and insulation layer 14 into the zinc coating zone 16 defined by bottom wall 13, side walls 17, and top wall 18. The bottom mouth of channel 12 has a bottom opening aperture 19 which is larger in diameter than the diameter of a wire 21 being galvanized. The aperture 19 can be varied by changing the size of base plug 22 in the bottom of channel 12. The top of channel 12 may be provided with a seal 23 (comprised of flexible asbestos or the like which aids in limiting and preventing the conceivably possible downward movement of zinc drops or the like from zinc coating stream 24 downwardly vertically through the channel 12, which is undesirable. Channel 12 and vessel 11 may have its wall portions comprised of heavy gauge sheet steel, if desired, with the insulation 14 being any suitable heat resistant inorganic material, as those skilled in the art will appreciate. The interior or vessel 11 may be heated by electric wire or rods 26 so as to maintain zinc lake 27 in a molten condition.

A wire 21 is preferably clean and otherwise processed as desired in a preprocessing station 28 prior to undergoing galvanizing in accordance with the teachings of this invention. After passing over a sheane 29, wire 21 is preferably passed through a pre-heating station here provided by a coiled wire 31 comprised of nichrome or the like which electrically heats the wire 21 to be galvanized.

Coating zone 16 is filled with a non-oxidizing gas via a conduit 32 which passes through, in the embodiment shown top wall 18 so that conduit 32 is adapted to supply to the interior of vessel 11 a substantially oxygen-free gas, as from a gas source (not shown).

Sheane 29 is journalled for rotational movement on a shaft 33 over vessel 11 another sheane 34 is positioned in an aligned vertical relationship as respects the circumferential edge portions thereof in relation to shieve 29 so that wire 21 can be extended between circumferential respective edge portions thereof thereby permitting the wire 21 to be drawn through the apparatus 10 (the powerhead being used to drive the capstan 34 or the like not being shown).

A reservoir 36 adapted for holding molten zinc 37 is provided within vessel 11. The reservoir 36 has a spigot 38 at a bottom side thereof. The level of zinc 37 in reservoir 36 is regulated by overflow pipe 38' which returns excess zinc from the reservoir 36 to the lake 27. A conduit 39 extends from below the level of lake 27 upwardly and across into the molten zinc 37 in reservoir 36. An impeller 41 is mounted at the lower end of a shaft 42 which extends upwardly through conduit 39 and through a shaft seal 43 in an upper wall of the vessel 11 to an electric motor drive means 44. As the impeller 41 revolves in response to rotational movements imparted thereto from the electric motor 44, the zinc in lake 27 is transported through conduit 39 into reservoir 36. A relatively constant stream of molten zinc can issue from spigot 38 during operation of apparatus 10. The aperture 46 in the mouth of reservoir 36 is so-sized that bracket 47 which upwardly extends from the reservoir 36 can be pivoted by arm 48 which is secured to bracket 47. Arm 48 is supported on bearing 49 in top wall 18 and arm 48 is pivoted by means of crank 49 secured to the upper end thereof by this means the exact location of stream 24 relative to a wire 21 undergoing coating can be regulated.

In vertical alignment with channel 12 an aperture 51 is provided in the top wall 18. Set into aperture 51 on flanges 52 is a chimney-like elongated (vertically) structure 53 which has a tapered upper end portion that terminates in an exit aperture 54 from which a galvanized wire 56 exits from apparatus 10 and zone 16. The chimney-like structure 53 provides an upward extension of zone 16 in the embodiment shown permitting a somewhat longer residence time for a galvanized wire 56 in an oxygen-free atmosphere. Conveniently and preferably a water quenching unit 57 is provided at the exit aperture 54 for use in terminally cooling galvanized wire 56 as it exits from the chimney-like structure 53. Thereafter, the galvanized wire 56 is moved over the shieve 34 and onto a take-up spool or the like (not shown) as desired. The small amounts of non-oxidizing gas which escape from zone 16 as through the exit aperture 54 and through the aperture 19 (past seal 23) can be made up by input gas entering via conduit 32. The level of the zinc lake 27 can be maintained by adding zinc pieces through hatch 58. The rim portion of hatch 53 is sealingly nested in a sand filled cross sectionally V-shaped channel 59 provided in top wall 18. Conveniently, the vessel 11 is divided into an upper half and a lower half permitting the upper half to be lifted away from the lower half for equipment excess or the like. A sealing engagement between upper half and lower half is maintained by a sand filled, V-shaped channel 61 circumferentially extending about the outside perimeter of the side walls 17, and a downturned flange at the bottom of the upper half of the vessel 11 is adapted to seat and rest in the interior of the channel 61, thereby affording and providing a gas seal, as desired.

After passing through the transversely moving zinc coating stream 24 a now-coated zinc wire 56 is passed vertically through a solid wipe subassembly designated in its entirety by the numeral 62. Any convenient solid wipe assembly can be employed. Such assembly may employ more than one successive stage or station for wire wiping. The wire 56 extends between mating halves 63 and 64 that together define between themselves a preformed channel whose cross sectional area is slightly larger than the cross-sectional area of the galvanized wire 56. The spatial location of the halves 63 and 64 of the wipe subassembly 62 is such that the halves 63 and 64 surround the wire 56 without deflecting same from its vertical path of movement. When the halves 63 and 64 are in their intended face-to-face abuting engagement with one another a downwardly projecting extension on the bottom portion of the chimney-like structure 53 is used to mount the base of mating half 63. Mating half 64 is moved translatably into and away from mating engagement with half 63 laterally by means of the threaded shaft 66 whose forward end 67 is adapted to engage the back facial portion of the mating half 64 in such a way that the vertical and horizontal orientation of the mating half 64 is not altered by revolutionary movement of the shaft 66 in the region of shaft 66 circumferentially which passes through the side wall 17 of vessel 11 a matingly threaded socket 68 is mounted by revolving the shaft 66 relative to the fixed socket 68 the shaft 66 is moved inwardly or outwardly by means of a crank 69 affixed to the outer end 71 of the shaft 66. By this means the solid wipe subassembly is disengaged from or engaged with the galvanized wire 56, as desired.

When the wipe subassembly 62 is engaged with wire 56 during operation of apparatus 10 the molten zinc coating on wire 56 is subjected to a smoothing action by the passage of the wire 56 through the solid wipe subassembly 62 and the mating halves 63 and 64 thereof. In apparatus 10, the interior of the chimney-like structure 53 is not isolated from the coating zone 16, as shown.

To maintain the desired spatial orientation for the mating half 64 relative to mating half 63 a pair of channel members can be employed wherealong the mating half 64 slides into and away from engagement with the mating half 63.

In operation, once a wire 21 is coated by molten zinc from coating stream 24 the molten zinc on the wire does not solidify by the time that the upwardly moving wire reaches the solid wipe subassembly 62 so that rearrangement of surface portions of the hot zinc on the wire can be and is accomplished by passage through the solid wipe subassembly 62. After passing through the solid wipe subassembly 62 the wire moves upwardly and, depending upon the conditions of operation of apparatus 10, a coated wire may undergo coating solidification before the coated wire emerges from the chimney-like structure 53 or not depending upon machine variables, as those skilled in the art will appreciate. By having the wire coated with molten zinc moving in a vertical direction at the time of solid wiping, the coating on the wire is relatively uniformly distributed over wire surfaces circumferentially so that smooth high quality coatings of zinc on product zinc coated wire are achieved through the practice of this invention.

Figure 3:
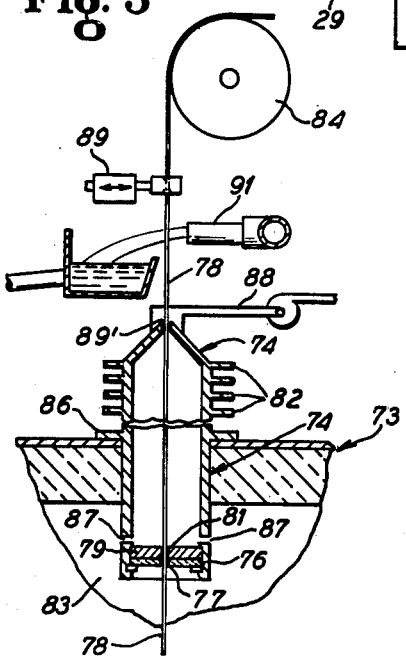
FIG. 3 is a view similar to FIG. 2 but showing a further embodiment of apparatus adapted for the practice of the present invention.

Referring to FIG. 3 there is seen a fragment of an apparatus suitable for carrying out the practice of this invention which is designated in its entirety by the numeral 73. Apparatus 73 is similar to apparatus 10 in construction except for the chimney-like structure 74. Here, the chimney-like structure 74 is provided with a preformed ceramic plate or disc which extends across the lowermost mouth of the chimney structure 74. The ceramic disk 76 is provided with an axial aperture 77 therein whose diameter is slightly larger than the diameter of galvanized wire 78. On the top side of ceramic disk 76 is positioned a reinforcing plate 79 which has a slightly larger aperture 81 axially located therein relative to the size of the aperture 77. The walls of the housing defining the chimney structure 74 are provided with a plurality of fins 82 in longitudinally (relative to the direction of wire movement) spaced relationship to one another. These fins 82 serve to permit radiation cooling of the walls of the chimney structure 74 (which is comprised of cast metal or the like) as a result of which the temperature in the interior of the chimney structure, particularly at the upper portions thereof, is lower than the temperature in the interior of the coating zone 83 of apparatus 73. As a consequence of the structure of the chimney structure 74, particularly as regards the lower temperature being maintained within the chimney structure 74 a more rapid cooling of galvanized wire 78 occurs in the interior of chimney structure 74 than occurs within the interior of the chimney structure 53 of apparatus 10 as those skilled in the art will appreciate. Into the interior of coating zone 83 the bottom portion of chimney structure 74 projects as the same is suspended thereinto by means of flanges 86 circumferentially extending about chimney structure 74. Through circumferential wall portions of chimney structure 74 in the coating zone 83 are provided a plurality of holes 87, gas is drawn into the interior of the chimney structure 74 from the coating zone 83 through the holes 87 as well as along the sides of the galvanized wire 78 as the same vertically upwardly moves. In this way, the interior of the chimney structure 74 is maintained in an oxygen free manner.

If desired, as for reasons of personnel safety in the vicinity of apparatus 73 a hood or gas catcher assembly 88 may be provided so as to minimize the dispersal and release of gas from the interior of chimney structure 74 into the ambient atmosphere surrounding the apparatus 10.

Optionally, but preferably, a galvanized wire moving through the chimney structure 74 is vibrated by means of vibrator assembly 89, which can preferably be of the ultrasonic type so as to minimize amplitude dislocations of galvanized wire 78). In this way, any coating irregularities remaining in or on the surface of the still molten coating layer on a wire 78 remaining after traversal through the ceramic disc 76 can be minimized.

If a wire 78 emerging from terminal orifice 89' of chimney structure 74 is still possessed of a molten zinc coating, a water quench can be provided as by a water quench spray or stream generating apparatus 91 located in adjacent relationship to the aperture 89' and to the gas catcher hood 88. Thus, in an actual working embodiment, the relationship between the water stream generating apparatus 91 and hood 88 is such that substantially no oxygen exposure of wire 78 occurs until after water quenching is accomplished.

If desired, the ceramic disc 76 can be removed from chimney structure 74 leaving only the reinforcing plate 79 with its central aperture 81 formed therein. Under this operating mode, a wire galvanized through the zinc galvanizing stream of apparatus 73 (not detailed) is not contacted with a solid wipe but rather is permitted to have a coating formed thereon which coating does not come into any contact with solid objects until after the coating thereon has been quenched. In this mode of operation, as well as in the preceding mode of operation, the interior of chimney structure 74 functions as a separate processing or cooling zone more or less independently of the coating zone 83.

Galvanized wire 78 from apparatus 73 can be processed in a manner similar to that employed for apparatus 10.

Figure 2:
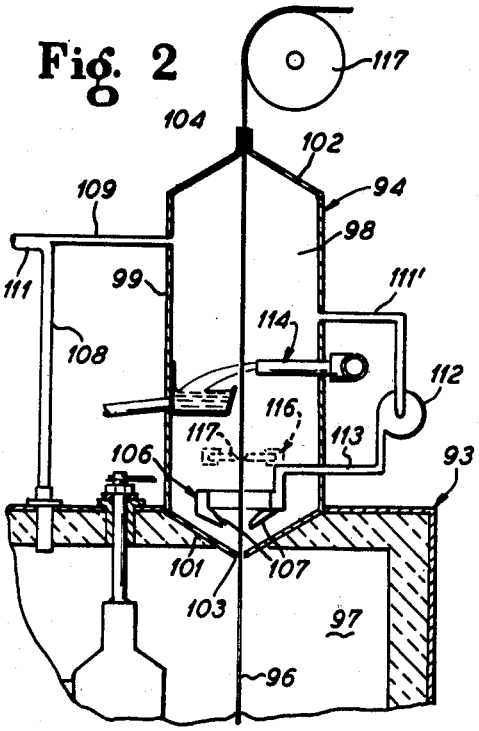
FIG. 2 is a schematic fragmentary partially sectionalized view similar to FIG. 1 but showing an alternative embodiment of apparatus adapted for the practice of the present invention.

Referring to FIG. 2 there is seen a still further embodiment of the invention. Here, an apparatus 93 is shown in fragmentary form the interior structure of the apparatus 93 can be considered to be similar to that employed in apparatus 10 except for the structure of the chimney arrangement 94 employed in the apparatus 93.

In apparatus 93, a wire 96 having a coating of still molten zinc moves vertically upwardly out of a coating zone 97 and into a second zone 98 which can be termed a plenum zone for present purposes. The plenum zone 98 is defined by a cross sectionally cylindrical housing 99 with tapered end walls 101 and 102, respectively. Each of the end walls 101 and 102 has an axial terminal aperture formed therein designated respectively as 103 and 104. The cross sectional dimensions of these respective apertures 103 and 104 is such that the galvanized wire 96 does not make contact with the adjacent respective end walls 101 and 102 as wire 96 passes therethrough.

Promptly after entering into the zone 98 the galvanized wire 96 is acted upon by gas wipe 106. In the embodiment shown, the gas wipe 106 is provided with three generally equally circumferentially spaced nozzles 107 which deliver compressed gas circumferentially and downwardly against the upwardly moving circumferential surfaces of wire 96 thereby affecting a smoothing of zinc metal deposited thereon. The gaseous atmosphere in zone 98 is of the non-oxidizing type and is identical in chemical composition to that employed in the coating zone 97. For this purpose, gas is systematically and continuously blead from the coating zone 97 into the plenum zone 98 via conduit 108 which connects with conduit 109, conduit 108 being joined to zone 97 at its lower end and to conduit 109 at its upper end and conduit 109 in turn being joined to the interior of the zone 98 at its opposed end from that at which connection with conduit 108 is accomplished. In addition, conduit 109 is supplied with compressed air via conduit 111 from a source (not detailed).

Gas in zone 98 is continuously removed via a conduit 111' being drawn into conduit 111 by a blower 112. Blower 112, in turn, compresses the gas received from zone 98 and delivers same via conduit 113 to the gas wipe 106. The interior temperatures of zone 98 are substantially below the interior temperatures of zone 97.

In operation, by means of a chimney structure 94 the cost of a high temperature operating compressor is avoided. As a wire 96 with molten zinc coating same enters the zone 98, the coating is still molten and a smoothing action is achieved by the gas wipe 106 before solidification of zine occurs. In order to be sure that solidification of zinc occurs in zone 98, a water quench assembly 114 is located in the zone 98.

If desired, in addition to gas wipe 106, one can locate in zone 98 after gas wipe 106 a solid wipe 116 whose construction is similar to that employed in the FIG. 3 apparatus using a ceramic disk 117 (in FIG. 2 the solid wipe subassembly 116 is shown in dotted lines as an optional feature).

Referring to FIG. 2, then, it will be appreciated that the following exemplary factors cause zone 98 to be at a lower temperature than the zone 97: Zone 98 is substantially isolated over and from the zone 97; the zone 98 is not insulated as regards its wall portions (in contrast to the wall portions of zone 97) so that a radiation heat loss from zone 98 can take place; when a water quench is employed in the zone 98, the zone 98 can be cooled by the water itself and by evaporation thereof; the make up gas being fed into zone 98 is generally cooler than the temperature of the gas in zone 97 supplied to zone 98 via conduit 108; and other factors.

A separate gas charging means may be employed for the galvanizing zone or plenum (the first zone) and for the wire subsequent processing zone or plenum (the second zone), if desired. Also, the second zone can be operated without any wire wipe means (solid or gas) if desired.

The composition of the material comprising a solid wipe (which defines an orifice) can vary widely. Suitable materials comprise ceramics, asbestos, carbon (including graphite), high temperature stable metal alloys, particularly those which are near resistant and the like. Carbon provides special effects. If a wire coated with molten zinc is wiped so as to remove much of the excess molten zinc therefrom, in my experience there is still left a coating on the surface of the wire. This residual coating is a reaction product or alloy composition formed between the steel wire and the (initial) zinc coating. This residual coating is oxidation resistant to an extent.

EMBODIMENTS

The present invention is illustrated by reference to the following Examples. Those skilled in the art will appreciate that other and further embodiments and examples are obvious and within the spirit and scope of this invention from the teachings of the present examples taken with the accompanying specification and drawings. All parts are parts by weight unless otherwise indicated.

Other and further embodiments and modifications will be apparent to those skilled in the art from a reading of the present specification and drawings and no undue limitations are to be drawn therefrom.

EXAMPLE 1

Using apparatus 10 generally of the type as shown in FIG. 1, with the solid wiping assembly 62, a steel wire is subjected to a galvanizing operation in accordance with the teachings of this invention. As the non oxidizing gas used in zone 16, natural gas is employed. The apparatus 10 is first purged with natural gas before the hot melt galvanizing operation is begun to remove substantially all atmospheric air from the interior of the apparatus after which the natural gas pressure is maintained in the apparatus somewhat above atmospheric pressure, as demonstrated by a vigorous flow of natural gas from aperture 54. The wire used is subjected to a preliminary degreasing operation through soaking the entire reel in methanol after which the wire is dried substantially completely in an oven at 350° F. Thereafter, wire from the reel is threaded and drawn through the apparatus 10 over the shieves 29 and 34 at the rate of about 20 feet per minute. The molten zinc bath is maintained at a temperature in the range of from about 830° F. to 870° F. The stream 24 of hot, molted zinc emerges from spigot 38 which is about $\frac{3}{4}$ inch in diameter.

Although the zinc is melted before the natural gas atmosphere in the apparatus is generated, the spout 38 is not opened until after the natural gas atmosphere is created, so that during the galvanizing operation only fresh molten zinc contacts the wire. While the wire passes through such stream of molten zinc and after coating before it contacts solid wipe halves 63 and 64. After passing through solid wipe halves 63 and 64, the resulting coated wire contacts no solid physical object until it reaches take-up shieve 34. Slightly above exit port 54 is located a water stream which passes horizontally from a nozzle and through which the zinc coated wire passes at is emerges from exit port 54. The zinc coated on the wire is cooled to a temperature below about 780° F. as shown by the fact that only solid zinc exists on the wire after passage through the water stream. The coated wire displays what appears to be a uniform thin coating of zinc. The natural gas may be ignited and burned as it exits from port 54 or from aperture 19.

EXAMPLE 2

Using apparatus 93 generally of the type as shown in FIG. 2, but without solid wiping assembly 117, a steel wire is subjected to a galvanizing operation generally in accordance with the teachings of Example 1. As the inert gas used in the apparatus 93, nitrogen is employed. The apparatus 93 is first purged with nitrogen before the hot melt galvanizing operation is begun to remove substantially all atmospheric air from the interior of the apparatus after which the nitrogen pressure is maintained in the apparatus somewhat above atmospheric pressure, as demonstrated by a vigorous flow of nitrogen from both the aperture 104. The wire used is subjected to a preliminary degreasing operation through soaking the entire reel in methanol after which the wire is dried substantially completely in an oven at about 350° F. Thereafter, wire from the reel is drawn through the apparatus 93 at the rate of about 20 feet per minute. The molten zinc bath is maintained at a temperature in the range of from about 830° to 870° F. The stream of hot, melted zinc emerges from the orifice which is about ¾ inch in diameter.

While the wire passes through such stream of molten zinc and afterwards until contacts shieve 117, it contacts no solid physical object. After passing from zone 97 into zone 98 through aperture 103, the vertically upwardly traveling molten zinc coated wire in zone 98 promptly passes through gas wipe 106 where a gas stream from nozzles 107 impinge against the coated wire and act to smooth and somewhat cool the zinc coating. As the wire continues thereafter in its travel, it passes through water quencher 114, wherein a water stream passes generally horizontally from a nozzle. Finally, the coated wire with solid coating emerges from aperture 104. The coated wire displays what appears to be a uniform thin coating of zinc.

EXAMPLE 3

Using apparatus 73, which is similar to apparatus 94 except that chimney structure 93 and associated components is replaced by chimney structure 74, a steel wire is subjected to a galvanizing operation generally in accordance with the teachings of Example 1. In combination with its associated components, the disc 76 functions to wipe the wire as coated with molten zinc drawn therethrough. Before reaching disc 76 after being coated with zinc, and after passing through disc 76 until it reaches shieve 84, the coated wire contacts no solid objects. The zinc coating is observed to be solidified as the wire emerges from aperture 89'.

I claim:

1. Apparatus for galvanizing a wire of galvanizable iron material comprising:

(A) a generally gas tight vessel means having a wire entry port and a wire exit port, said exit port being located in a top portion of said vessel, (B) gas charging means associated with said vessel means and adapted to supply the interior of said vessel with a substantially oxygen-free gas including gas flow regulating means, (C) reservoir means having spigot means all located in said vessel and adapted to discharge from the spigot mouth thereof a stream of molten zinc moving in a generally transverse horizontal direction.

(D) supply means associated with said reservoir means and adapted to deliver thereto molten zinc, (E) wire transport means adapted to position a length of said wire vertically and to move said wire vertically upwardly via said ports through said vessel means in spaced adjacent relationship to said spigot mouth and in a stream of molten zinc issuing therefrom, thereby coating said wire with said molten zinc, said wire transport means including two sheave means, which are in an aligned vertical spaced relationship relative to one another as respects a respective circumferential edge portion of each and which are adapted to move said wire vertically from one to the other of such circumferential edge portions, one of said sheave means being located below said vessel means, the other of said sheave means being located above said vessel means, (F) said vessel means being divided into two chambers, one chamber being located substantially over and having an entrance portion extending partially into the other thereof, said spigot means said reservoir means and said supply means being in the other one of said chambers, said one chamber communicating with said other chamber through said entrance portion for passage of said wire from said entry port through said chambers and out said exit port.

(G) said upper chamber including means (adapted to) for maintaining said upper chamber at a generally cooler interval operating temperature than said lower chamber, and (H) wire wipe means, including mounting means therefor, located in said upper chamber adjacent said lower chamber, and in fixed relationship to said vertically movable wire along the path of wire travel thereof, said wire wipe means having smoothing means for the molten zinc coating on said wire moving therethrough, said smoothing means comprising solid members defining an orifice having a generally vertically oriented axis and having a cross sectional configuration which is generally proportional to the cross sectional configuration of said wire, thereby adapting said orifice to conform exterior surface portions of such zinc coating on said wire to such cross-sectional configuration of said orifice, (I) said vessel means, said supply means, said wire transport means, and said wire wipe means cooperating with one another to permit said wire so vertically positioned and so upwardly moving to be free from contact with any solid object except for said smoothing means until after said zinc coating on said wire has solidified.

2. The apparatus of claim 1 further including wire water quench means in said upper chamber in overlying relationship to said smoothing means.

3. The apparatus of claim 1 further including adjacent said upper chamber a vibrator assembly for vibrating a galvanized wire moving therethrough.

4. The apparatus of claim 1 wherein said entrance portion is defined by said smoothing means.

5. The apparatus of claim 1 wherein said wire wipe means comprises a gas wipe means and said solid members successively located along said path of wire travel.

* * * * *